United States Patent [19]

Helling et al.

[11] Patent Number: 4,714,671

[45] Date of Patent: Dec. 22, 1987

[54] COLOR PHOTOGRAPHIC RECORDING MATERIAL CONTAINING A POLYMERIC GELATINE PLASTICIZER

[75] Inventors: Günter Helling, Odenthal; Wolfgang Himmelmann, Leverkusen, both of Fed. Rep. of Germany

[73] Assignee: Agfa Gevaert Aktiengesellschaft, Leverkusen, Fed. Rep. of Germany

[21] Appl. No.: 855,701

[22] Filed: Apr. 25, 1986

[30] Foreign Application Priority Data

May 8, 1985 [DE] Fed. Rep. of Germany ..... 3516466

[51] Int. Cl.[4] ..... G03C 1/31; G03C 1/04; G03C 7/26

[52] U.S. Cl. ..... 430/545; 430/537; 430/546; 430/627; 430/631; 430/640

[58] Field of Search ..... 430/537, 493, 545, 546, 430/627, 631, 640

[56] References Cited

U.S. PATENT DOCUMENTS 4,510,238 4/1985 Kingston et al. ..... 430/627

*Primary Examiner*—Richard L. Schilling
*Assistant Examiner*—Lee C. Wright
*Attorney, Agent, or Firm*—Connolly & Hutz

[57] ABSTRACT

Polymer latices in which the dispersed particles consist of a soft core and a hard shell are suitable plasticizers for gelatine in photographic recording materials.

7 Claims, No Drawings

COLOR PHOTOGRAPHIC RECORDING MATERIAL CONTAINING A POLYMERIC GELATINE PLASTICIZER

This invention relates to a colour photographic recording material comprising at least one gelatine-containing layer containing at least one photographic auxiliary substance in the form of a dispersion containing oil former and at least one polymeric plasticizer for gelatine.

Gelatine is the substance mainly used in photography as hydrophilic layer colloid for light-sensitive silver halide emulsion layers and other auxiliary layers. The physical properties of a gelatine layer, e.g. its brittleness, elasticity and cold strength, depend to a large extent on the atmospheric moisture (relative humidity). Severe drying brings into play large tensile forces which may cause deformation of the support. Gelatine-containing photographic emulsions which have been cast on triacetyl cellulose films break under very dry conditions and when subjected to sudden bending. The break is transmitted through the laminate, often leading to breakage of the support. There has therefore been no lack of attempts to improve the mechanical properties of such layers even under very dry conditions by the addition of gelatine plasticizers.

Hygroscopic substances such as alcohols or glycerol are known to be plasticizers for gelatine layers but they impart a moist handle to the layers or in the event of exceptionally low atmospheric moisture may even increase the brittleness of the gelatine layers. The following have therefore been proposed:

Amides of carboxylic acids or various copolymers, in particular of acrylic acid esters, acrylonitrile or acrylamide. All these products, however, have various disadvantages.

One of the main disadvantages is that these substances, especially those with a low molecular weight, are readily washed out in the course of processing so that there is a loss of plasticizing effect, and another disadvantage is that these additives cause cloudiness of the layers, thereby impairing the photographic properties. The latter applies particularly to the higher molecular weight, water-insoluble softeners.

High molecular weight polyether and polyester polyurethanes containing anionic or cationic groups in the polyurethane chain have acquired some importance as plasticizers for gelatine. The anionic polyurethanes, however, are only of limited significance. Polymer latices of water-insoluble polyacrylic acid esters and their water-insoluble copolymers have proved to be both inexpensive and exceptionally effective in reducing the tensile forces and eliminating the tendency of layers to roll up under dry atmospheric conditions. The important characteristic of such polymers is not so much their chemical composition as their $T_g$-value (glass transition temperature) which should as far as possible be below −20° C. Polyethylacrylate and polybutylacrylate are particularly suitable representatives of this class. They may also contain other comonomers.

Photographic recording materials comprise layers of binder which may contain water-soluble colour couplers and/or other photographically active substances in the form of dispersions in which the disperse phase consists of a mixture of oil formers and colour couplers. Oil formers are high boiling solvents which prevent or render more difficult the crystallisation of substances dissolved in them. Most oil formers have a plasticizing effect on synthetic resins. Many of them consist of phosphoric acid esters, phthalic acid esters or fatty acid amides.

It is often found to be disadvantageous to use polymer latices having a plasticizing effect, especially in layers of binder containing photographically active compounds such as colour couplers in the form of dispersions containing oil formers. The particles of plasticizer constitute a third phase in addition to the hydrophilic binder phase and the hydrophobic phase formed by the particles of oil former. When stored under tropical conditions, these particles of softener gradually withdraw oil former from the particles of dispersion containing oil former, with the result that these dispersions become depleted of oil former. Agglomeration and crystallisation of the photographically active substances dissolved therein is an inevitable consequence combined with an increase in grainines, a lowering in the reactivity of the dissolved photographically active substances, e.g. the colour couplers, and a loss of sharpness due to increased dye diffusion. At the same time, the oil former accumulates in the particles of the plasticizer composed of polymer latex so that the particles of plasticizer aggomerate and stick together. This undesirable effect does not occur when the plasticizers used are latices of polymers having a glass transition temperature $T_g$ above 35° C. but the softening effect is then not entirely satisfactory.

It is an object of the present invention to provide plasticizers based on soft latex polymers for use in colour photographic recording materials, in which the particles of polymer latex are so modified, but without loss of plasticizing effect, that the disadvantages mentioned above, such as agglomeration and crystallisation of the photographically active substances and the resultant impairment of photographic results and sticking of the particles of plasticizer do not occur.

The present invention relates to a colour photographic recording material having at least one gelatine-containing layer of binder containing at least one photographic auxiliary substance in the form of a dispersion containing oil former and at least one plasticizer for gelatine, characterised in that the layer of binder contains, as softener for gelatine, a polymer latex in which the dispersed particles consist to an extent of 80 to 95% by weight of a soft core and 5 to 20% by weight of a hard shell.

Polymers may be classified as hard or soft on the basis of their transition temperature($T_g$-value). The glass transition temperature is determined by differential scanning calorimetry (G. W. MILLER, Applied Polymer Symposia No. 10, (1969), pages 35 to 72). Polymers which are soft within the meaning of the present invention are especially those which have a glass transition temperature below −10° C. whereas hard polymers for the purpose of this invention are particularly those having a glass transition temperature above 36° C.

The plasticizer according to the invention is thus a so-called "core/shell" polymer latex, i.e. a dispersion of particles dispersed in a hydrophilic phase, in which the interior of the particles consisting of a soft polymer, hereinafter referred to as "core polymer", and the outer shell consists of a hard polymer, hereinafter referred to as the "shell polymer".

Core/shell polymers are prepared by forming a so-called seed latex from a suitable monomer or mixture of comonomers by emulsion polymerisation in a first stage and then forming a polymer shell on the particles of seed latex in a second stage by adding another monomer or mixture of comonomers. The core and the shell of the resulting particles differ in their composition in dependence upon the monomers or monomer mixtures used. In the phase interface zone between the core and shell, the composition may change either suddenly or continuously. In particular, the phase interface zone may contain graft polymers in which monomers for the shell are grafted on the polymer of the core. The morphology and structure of such core/shell polymer latices which differ distinctly in their properties from mixtures of latices of the corresponding separately prepared core polymers and shell polymers have been analytically investigated and described by T. I. MIN et al in J. Polym. Sci. Chem. Ed., Vol.21, 2845–2861 (1983).

Both the core polymer and the shell polymer consist of polymers of polymerisable, olefinically unsaturated monomers such as, for example, $\alpha,\beta$-unsaturated mono- and dicarboxylic acids or their esters or amides, or compounds containing vinyl groups, such as vinyl chloride, vinyl esters, vinyl ethers, vinyl-substituted carbocyclic and heterocyclic compounds, vinylidene chloride, butadiene, isoprene, acrylonitrile and methacrylonitrile.

The following are examples of $\alpha,\beta$-unsaturated carboxylic acids and derivatives thereof: Acrylic acid, methacrylic acid, crotonic acid, itaconic acid, citraconic acid, ethyl acrylate, methyl methacrylate, butyl acrylate, amyl acrylate, 2-ethylhexyl acrylate, isopropyl methacrylate, hexyl methacrylate, 2-hydroxyethyl acrylate, 2-butoxyethyl acrylate, 2-phenoxyethyl acrylate, cyanoethyl acrylate, dimethylaminoethyl acrylate, cyclohexyl methacrylate, benzyl methacrylate, dimethyl acrylamide. N-hydroxyethyl acrylamide and methylene-bis-acrylamide.

The following are examples of compounds containing vinyl groups: Vinyl acetate, vinyl butyl ether, vinyl laurate, styrene, vinyl toluene, divinyl benzene, N-vinyl pyrrolidone and 2-vinyl pyridine.

The soft core of the core/shell polymers according to the invention may consist of polymers of the kind which have already been described as polymeric softeners for gelatine. On this core is grafted a shell of a hard polymer, i.e. polymerisation is continued with a monomer mixture to form a hard shell. Formation of the shell may be controlled by means of suitable particle size measuring apparatus (W. P. Sorenson, T. W. Campbell, "Preparation Methods of Polymer Chemistry", 2nd Edition, Interscience Publishers, N.Y.).

Styrene and alkyl methacrylate containing 1 to 4 carbon atoms in the alkyl moiety and monomer mixtures consisting of the aforesaid monomers to an extent of at least 55% by weight are particularly suitable for forming the shell.

Monomers which have a cross-linking action may also be used, particularly for forming the shell, e.g. polyfunctional comonomers such as divinylbenzene, methylene-bis-acrylamide, trivinylcyclohexane, tetraallyloxyethane, butanediol diacrylate, methacrylic acid allyl esters, and the like. These cross-linking monomers are preferably used in quantities of up to 5% by weight.

Water-soluble monomers may also be used as comonomers in the shell, e.g. in quantities of up to 20% by weight. Examples include N-vinylpyrrolidone, suitably substituted acrylamides or methacrylamides, N-vinyl-N-methylacetamide, sulphoalkyl acrylates or methacrylates, and sulphoalkyl acrylamides or methacrylamides, e.g. 2-methyl-2-acrylamidopropane sulphonic acid.

The core/shell plasticizer latices according to the invention are non-ionically and/or anionically stabilized, i.e. the particles have either no surface charge or a negative surface charge. Cationic comonomers and cationic wetting agents and emulsifiers are not suitable for the preparation and stabilization of the latices according to the invention since flocculation occurs when cationic latices are mixed with the anionically stabilized emulsifiers and emulsions.

Monomers which have an effect on the image are not suitable for use in the preparation of the core/shell latices according to the invention serving as softeners since the latices according to the invention should be applicable as far as possible universally for softening different types of layers. Monomers which have an image effet are, for example, colour coupler monomers, white coupler monomers, dye monomers, etc.

The $T_g$- value of copolymers may be assessed by means of the equation of Gordon-Talyor, J. Appl. Chem. 2, 492 (1952). In the form of $$(T_g-T_A)W_A+K\,(T_g-T_B)W_B=0$$

it enables the glass transition temperature $T_g$ of a particular copolymer to be calculated if the glass transition temperature of the corresponding homopolymers $T_A$ and $T_B$ and the portions by weight $W_A$ and $W_B$ of the corresponding comonomers in the copolymer are known. It is thus possible to make a suitable choice of monomers for constructing the core or shell. The $T_g$ values of conventional homopolymers are tabulated in "Polymer Handbook" by Brandup et al, Interscience Publishers, Wiley and Sons, New York, 1966.

Examples of suitable core-shell plasticizer latices according to the present invention are shown below (% by weight):

| | | |
|---|---|---|
| Compound 1 | | |
| Core: | polybutyl acrylate | 90% |
| Shell: | polystyrene | 10% |
| aqueous dispersion: | | 20.9% by weight |
| (wetting agent: | TRITON ® 770*) | |
| average particle size | 103 nm | |
| Compound 2 | | |
| Core: | polybutyl acrylate | 95% |
| Shell: | polystyrene | 5% |
| aqueous dispersion: | | 18.8% |
| wetting agent: | TRITON ® 770 | |
| Compound 3 | | |
| Core: | polybutyl acrylate | 90% |
| Shell: | polymethyl methacrylate | 10% |
| aqueous dispersion: | | 20.2% |
| wetting agent: | DOWFAX ® 2A1** | |
| Compound 4 | | |
| Core: | polybutyl acrylate | 90% |
| Shell: | copolymer of 9% styrene and 1% divinyl benzene | 10% |
| aqueous dispersion: | | 20.7% |
| wetting agent: | DOWFAX ® 2A1 | |
| Compound 5 | | |
| Core: | polyethylhexyl acrylate | 90% |
| Shell: | polystyrene | 10% |
| aqueous dispersion: | | 16.3% |
| wetting agent: | DOWFAX ® 2A1 | |
| Compound 6 | | |
| Core: | polyethylhexyl acrylate | 80% |
| Shell: | polystyrene | 20% |
| aqueous dispersion: | | 17.4% |
| wetting agent: | DOWFAX ® 2A1 | |
| Compound 7 | | |
| Core: | Copo butyl acrylate/hydroxyethyl acrylate (81:9) | 90% |

-continued

| | | |
|---|---|---|
| Shell: | butyl methacrylate | 10% |
| aqueous dispersion: | | 18.6% |
| wetting agent: | DOWFAX ® 2A1 | |
| Compound 8 | | |
| Core: | Copo butyl acrylate/ethyl acrylate (1:1) | 88% |
| Shell: | polymethyl methacrylate | 12% |
| aqueous dispersion: | | 19.3% |
| wetting agent | DOWFAX ® 2A1 | |
| Compound 9 | | |
| Core: | Copo butyl acrylate/ethyl hexyl acrylate (50:36) | 86% |
| Shell: | Copo styrene/butyl methacrylate (8:6) | 14% |
| aqueous dispersion: | | 18.8% |
| wetting agent | DOWFAX ® 2A1 | |
| Compound 10 | | |
| Core: | polybutyl acrylate | 92% |
| Shell: | Copo methyl methacrylate/acrylamide (7:1) | 8% |
| aqueous dispersion: | | 18.5% |
| wetting agent: | DOWFAX ® 2A1 | |
| Compound 11 | | |
| Core: | polyethyl acrylate | 90% |
| Shell: | Copo styrene/acrylamidomethyl propane sulphonic acid (7:3) | 10% |
| aqueous dispersion: | | 19.3% |
| wetting agent | DOWFAX ® 2A1 | |

*

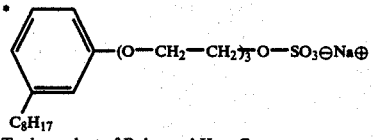

Trade product of Rohm and Haas Corp.

**

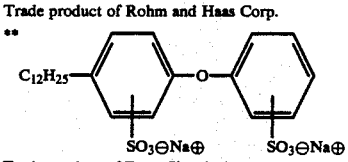

Trade product of Dow Chemical

The core/shell polymer latices according to the invention differ distinctly in their properties from mixed polymer latices in which the core polymer and the shell polymer (prepared separately from one another) are present as a mixture. The core/shell latices according to the invention provide a marked improvement in the stability of the photographic recording material, in particular under tropical storage conditions, combined with a good plasticizing effect whereas the desired improvement in properties is not obtained with the mixtures.

It was by no means foreseeable to the man of the art that the hard shell built round the soft core of the core polymer would not interfere with the plasticizing effect of the core polymer when used in colour photographic layers containing gelatine.

The core/shell polymer latices according to the invention are advantageously added to the casting solutions immediately before casting, either directly or after mixing them with aqueous gelatine, for example in proportions of from 1:1 to 1:2. In this way, both plasticizer and additional gelatine can be incorporated in a single working step. The quantity of polymeric plasticizer added amounts to 0.05–1, preferably 0.1–0.5 parts by weight to 1 part by weight of gelatine.

Gelatine which has been plasticized by an addition of the compounds according to the invention may be modified in the usual manner by the addition of other substances, such as high molecular weight, water-soluble or water-insoluble compounds. The following are examples of such high molecular weight, water-soluble weight, water compounds:

Polyvinyl pyrrolidone, polyvinyl methyl ether, polyvinyl alcohol, polyacrylic and -methacrylic acid, polymaleic acid, polystyrene sulphonic acid, polyvinyl sulphonic acid and all copolymers of these compounds, and naturally occurring materials such as gum arabic, dextrans, laevans and other soluble polysaccharides.

Plasticizers can easily be mixed with colour couplers in colour photographic emulsions containing conventional water-soluble colour couplers in the form of oil former mixtures in an emulsion containing gelatine, in which case only one instead of two additional solutions are required. Flocculation of the colour coupler does not occur in the process of drying the casting solutions.

The layers obtained are less brittle than comparable layers which do not contain polymeric plasticizer and they have less tendency to roll up and yet adhere firmly to their support. There is virtually no change in the photographic properties and even in storage under tropical conditions there is no increase in the colour graininess, no crystallisation and no diffusion of dye which would result in a reduction in sharpness of the image.

No change need be made to the conventional casting additives such as hardeners, wetting agents, spectral sensitizers or development accelerators since the compounds according to the invention have no effect on these additives. The plasticizers according to the invention are equally suitable for all types of photographic layers containing gelatine.

The term "photographic layers" is to be understood in this context to mean any layers in general used for photographic recording materials, e.g. light-sensitive silver halide emulsion layers, protective layers, filter layers, anti-halation layers, backing layers and any photographic auxiliary layers in general.

The light-sensitive emulsion layers for which the plasticizers according to the invention are particularly suitable include, for example, layers based on light-sensitive silver halide emulsions of all kinds. The softener according to the invention is thus very suitable for use in recording materials of the kind used for a wide variety of black-and-white and colour photographic processes such as negative, positive and diffusion transfer processes or printing processes. The plasticizer according to the invention is found to be particularly advantageous for use in photographic combinations of layers used for carrying out colour photographic processes, and especially photographic recording materials containing emulsion layers with colour couplers incorporated in the layers in the form of emulsifiers containing oil formers.

The action of the polymers employed according to the invention is not impaired by the usual photographic additives and the plasticizers are inert towards photographic ally active substances such as water-soluble and emulsified water-insoluble colour components, stabilizers, sensitizers and the like. Moreover, they have no deleterious effect on the light-sensitive silver halide emulsion.

The light-sensitive components of the emulsion layers may be any known silver halides, such as silver chloride, silver iodide, silver bromide, silver iodobromide, silver chlorobromide, silver chloroiodobromide or the like. The emulsions may be chemically sensitized with noble metal compounds, e.g. compounds of ruthenium, rhodium, palladium, iridium, platinum, gold and the like, such as ammonium chloropalladate, potassium chloroplatinate, potassium chloropalladate or potassium chloroaurate. They may also contain special sensitizers such as sulphur compounds.

The emulsions may be spectrally sensitized in known manner, e.g. with the usual polymethine dyes such as neutrocyanines, hemicyanines, styryl dyes, oxonoles and the like. Sensitizers of this kind have been described by F. M. Hammer in "The Cyanine Dyes and related Compounds" (1964). See in this connection in particular Ullmanns Enzyklopädie der technischen Chemie, 4th Edition, Volume 18, pages 431 et seq and Research Disclosure No. 17643, Section IV.

The emulsions may also contain the usual anti-fogging agents and stabilizers. Azaindenes are particularly suitable stabilizers, especially tetra- and pentaazaindenes and in particular those which are substituted with hydroxyl or amino groups. Compounds of this kind have been described in the article by Birr, Z.Wiss.Phot 47, 1952, pages 2 to 27. Other suitable stabilizers and anti-fogging agents are indicated in the above-mentioned Research Disclosure No. 17634, Section VI.

The layers of photographic recording material may be hardened in the usual manner, for example with hardeners of the epoxide type or the heterocyclic ethyleneimine or acryloyl type. The layers may also be hardened by the process according to DE-A-2 218 009 to produce colour photographic materials suitable for high temperature processing. Moreover, the photographic layers or colour photographic multilayered materials may be hardened with hardeners of the diazine, triazine or 1,2-dihydroquinoline series or with hardeners of the vinylsulphone type. Other suitable hardeners have been disclosed in German Offenlegungsschriften Nos. 2 439 551, 2 225 230 and 2 317 672 and the above mentioned Research Disclosure 17643, Section XI.

The colour photographic recording materials according to the invention contain the core/shell polymers of the present invention in one or more layers, especially in those layers which contain a photographic auxiliary substance in the form of a dispersion which contains oil formers. These auxiliary substances may be conventional additives which by virtue of their hydrophobic character or also for other reasons are used in the form of a solution in an oil former. Examples of such photographic auxiliary substance include colour components, anti-oxidants, reducing agents, UV absorbents and light-protective agents.

The colour components may in principle be any type of non-diffusible compounds from which image dyes having the desired spectral and sensitometric properties can be produced by suitable treatment (development). For example, they may be so-called colour producing compounds which are incorporated in the layers in a diffusion-fast form and from which diffusible image dyes are released in the course of photographic development to be transferred to an image receptor layer. The colour components are preferably non-diffusible colour couplers which are capable of reacting with the colour developer oxidation products to form a non-diffusible dye. The non-diffusible colour couplers are preferably accommodated directly in the light-sensitive layer or in close proximity thereto.

The colour components and in particular the colour couplers are generally associated with a silver halide emulsion layer, i.e. they normally give rise to a colour which is complementary to the colour of the light to which the particular silver halide emulsion layer is sensitive. However, the colour coupler associated with the red-sensitive silver halide emulsion layers is a non-diffusible colour coupler for producing the cyan partial colour image, generally a coupler of the phenol or $\alpha$-naphthol series. Associated with the green-sensitive silver halide emulsion layers is a non-diffusible colour couplers for producing the magenta partial colour image, normally a coupler of the 5-pyrazolone, pyrazoloazole or indazolone series, while the colour coupler associated with the blue-sensitive silver halide emulsion layers is a non-diffusible colour coupler for producing the yellow partial colour image, generally a colour coupler containing an open chain ketomethylene group. A large number of such colour couplers is known and has been described in numerous Patent Specifications. Reference may be made, for example, to the publications "Farbkuppler" by W. PELZ in "Mitteilungen aus den Forschungslaboratorien der Agfa, Leverkusen/-München", Volume III, page 111 (1961) and K. VENKATARAMAN in the "The Chemistry of Synthetic Dyes", Vol. 4, 341 to 387, Academic Press, (1971).

The colour couplers may be either conventional 4-equivalent couplers or 2-equivalent couplers which require a smaller quantity of silver halide for colour production. As is known, 2-equivalent couplers are derived from 4-equivalent couplers in that the coupling position carries a substituent which is split off in the process of coupling. The 2-equivalent couplers which may be used according to the present invention include both those which are virtually colourless and those which have an intense colour of their own which, however, disappears in the course of colour coupling or is replaced by the colour of the image dye produced. According to the present invention, the last mentioned couplers may also be present in the light-sensitive halide emulsion layers, where they may serve as masking couplers to compensate for unwanted side densities of the image dyes. The 2-equivalent couplers also include the known white couplers which do not give rise to a dye in their reaction with colour developer oxidation products, as well as the known DIR couplers which also carry in their coupling position a removable group which is released as diffusible development inhibitor in the reaction with colour developer oxidation products. These couplers may form a dye but mainly only give rise to colourless products.

If required, a particular colour shade or reactivity can be obtained by using mixtures of colour couplers. For example, water-soluble couplers may be used in combination with hydrophobic, water-insoluble couplers.

EXAMPLE 1

Preparation of the core/shell latices according to the invention

Compound 1 core/shell latex of 90 parts of polybutylacrylate (core) and 10 parts of polystyrene (shell)

A mixture of 3.3 g of 30% Triton$^{(R)}$ 770 solution and 300 ml of water was heated to 70° C. while nitrogen was passed through the mixture. A solution of 1 g of sodium metabisulphite in 30 ml of water, 1 g of potassium peroxy disulphate in 30 ml of water and 90 g of butyl acrylate was then continuously added dropwise at the same time within 2 hours. After a further 2 hours' stirring at 70° C., 10 g of styrene and 0.1 g of potassium peroxy disulphate in 30 ml of water were added dropwise and stirring was continued for a further 2 hours at 80° C. A finely divided latex was obtained.
Solids content: 20.9%
Particle size: 103 nm Compounds 2 to 18 were prepared similarly from other monomers.

In the case of Compounds 7 to 11, the paricle sizes of both the core/shell latices and of the seed latices (core latices) put into the process were measured and the results entered in Table 1.

TABLE 1

| | Particle size [nm] | |
|---|---|---|
| | Seed latex | core/shell latex |
| Compound 7 | 67 | 69 |
| Compound 8 | 73 | 76 |
| Compound 9 | 72 | 77 |
| Compound 10 | 87 | 90 |
| Compound 11 | 66 | 72 |

It may be seen from Table 1 that when the monomer or monomer mixture for the shell is added, the particles of seed latex present continue to grow but no new particles are formed.

EXAMPLE 2

A casting solution having the composition described below was applied to a cellulose triacetate support carrying a 2.5 μm thick anti-halation layer on gelatine containing black colloidal silver:

| | |
|---|---|
| 13.9 g gelatine<br>2.4 g softener<br>9.6 g colour coupler<br>4.8 g tricresyl phosphate<br>10.2 g silver halide | in 320 ml of water. |

Layers 4 μm in thickness containing 37 vol.-% of gelatine and 7.4 vol.-% of softener were prepared.

In a second test series, layers containing 40 vol.-% of gelatine and 8 vol.-% of softener when dry were cast on the antihalation layers. The volumetric proportions of gelatine and softener were in all cases 5:1.

The plasticizers used were in some cases the core-shell polymer latices according to the invention and in others a polybutyl acrylate latex for comparison. The layers were exposed with a resolution test chart and colour developed and processed in conventional manner.

Compounds corresponding to the following formulae were used as colour couplers:

TABLE 2

| Softener | Gelatine Vol.-% | Sharpness Resolving power fresh | L/min after tropical storage |
|---|---|---|---|
| Comparison: | | | |
| Polyethyl- | 37% | 59 | 14 |
| acrylate | 40% | 59 | 51 |
| Polybutyl | 37 | 59 | 14 |
| acrylate | 40 | 49 | 35 |
| according to the invention: | | | |
| Compound 1 | 37 | 73 | 67 |
| | 40 | 67 | 59 |
| Compound 2 | 37 | 73 | 67 |
| | 40 | 67 | 59 |
| Compound 3 | 37 | 59 | 59 |
| | 40 | 53 | 51 |
| Compound 10 | 37 | 67 | 59 |
| | 40 | 67 | 59 |

The results in Table 2 show that diffusion of the yellow dye under tropical conditions is greatly reduced in the case of core/shell plasticizer latices compared with that obtained with the conventional softener latices, polyethyl acrylate and polybutyl acrylate. When the softeners according to the invention are used, it is possible to produce thinner layers with a lower gelatine content without serious defects occuring under tropical conditions.

EXAMPLE 3

A cyan coupler emulsion was prepared as follows: 7 g of coupler 2 and 3 g of coupler 3 dissolved in 8 g of tricresylphosphate and 30 ml of ethyl acetate were dispersed in a solution of 5 g of gelatine in 73.5 ml of water together with 3.5 ml of a 10% aqueous solution of sodium-triisopropylnaphthalene sulphonate, and the ethyl acetate was then evaporated off.

Gelatine and plasticizer latex were added to the resulting cyan coupler emulsion in the quantities required to produce the following stock solutions(figures in percent by weight, based on the total solids content):

| | |
|---|---|
| Stock solutions 1: | 35% by weight gelatine<br>10.5% by weight softener |
| Stock solutions 2: | 40% by weight gelatine<br>12% by weight softener |

The stability of the stock solutions were determined by drying them on glass plates and assessing the quantity of components diffusing out both before and after tropical storage (4 days/35° C./80% relative humidity).

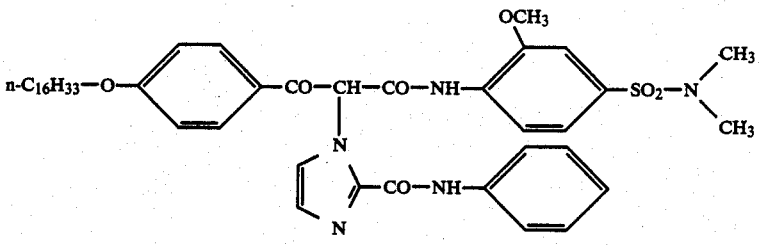

Coupler 1

The sharpness or resolving power in lines/mm was determined in each case before and after 6 days' storage under tropical conditions (60° C./100% relative humidity) and the results entered in Table 2 were obtained.

The components which diffused out consisted of the oil former tricresyl phosphate and colour couplers, which can be demonstrated by paper chromatography.

TABLE 3

| plasticizer latex | Stock solution | Diffusion: Storage at room temperature | Diffusion: after tropical storage |
|---|---|---|---|
| Comparison: | | | |
| Polyethyl acrylate | 1 | + | +++ |
| | 2 | + | +++ |
| Polybutyl acrylate | 1 | + | +++ |
| | 2 | + | ++ |
| according to the invention: | | | |
| Compound 1 | 1 | – | – |
| | 2 | – | – |
| Compound 3 | 1 | – | – |
| | 2 | – | – |
| Compound 7 | 1 | + | |
| | 2 | – | – |
| Compound 8 | 1 | – | – |
| | 2 | – | – |
| Compound 10 | 1 | – | + |
| | 2 | – | – |

Definition of symbols:
+++ High diffusion from coupler/oil former/mixture, deposit can be wiped off
++ Moderate diffusion; droplets are microscopically visible
+ Weak diffusion, only isolated areas of deposit
– No diffusion Table 3 shows that the stability of the stock solutions and dispersions is very high in case of the softener latices according to the invention. The plasticizer latex does not interact with the coupler particles containing oil former. In the dried layers, coupler particles containing oil former do not mix with latex during storage under tropical conditions, in contrast to layers containing the comparison plasticizers.

The following cyan couplers were added:

Coupler 2

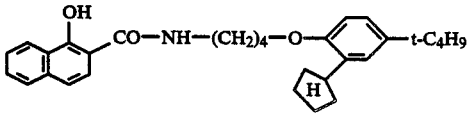

EXAMPLE 4

A red-sensitized cyan emulsion layer 15 μm in thickness was applied to a cellulose triacetate support carrying a 4 μm thick anti-halation layer consisting of gelatine and black colloidal silver.

The layer contained per $m^2$:
8.129 g of gelatine
3.298 g of softener
2.177 g of thicresylphosphate
2.7 g of colour coupler 3
7.13 g of silver bromide
(40 vol.-% gelatine, 20 vol.-% softener, based on the total solids content).

The plasticizers used were the core/shell latices according to the invention and, for comparison, polyethyl acrylate and polybutyl acrylate.

After drying, the layers were adjusted to extremely dry atmospheric conditions of 10° C. and 12% relative humidity.

The brittlenes was determined by the apparatus described below.

Coupler 3

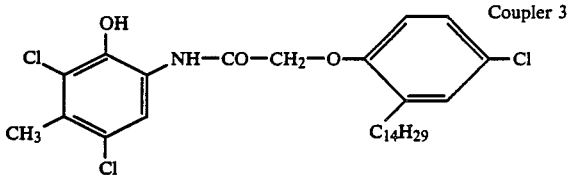

A loop of film with the emulsion facing outwards was clamped into an implement of parallel jaws with force measuring tin. Squeezing at the rate of 10 cm/s, the movable jaw moves against the fixed jaw to a position where it reaches double the film thickness, and then turns back again.

The force/path graph is recorded electronically and automatically by a XY writing device.

When the film breaks, 1. the breaking force and
2. the diameter of the loop at breakage are measured. The higher the breaking force and the smaller the diameter of the loop, the lower is the brittleness of the film.

TABLE 4:

| Plasticizer latex | Breaking strength in extremely dry atmospheric conditions (10° C., 12% relative humidity): Loop diameter on breakage [mm] | Breaking force [N] |
|---|---|---|
| Comparison: | | |
| Polyethyl acrylate | 2.4 | 19 |
| Polybutyl acrylate | 2.5 | 20 |
| according to the invention: | | |
| Compound 7 | 2.3 | 20 |
| Compound 8 | 2.0 | 23 |
| Compound 9 | 1.8 | 27 |
| Compound 11 | 1.6 | 26 |
| Compound 10 | 1.8 | 23 |

Table 4 shows that breakage occurs at a smaller loop diameter in the case of the core-shell latex softeners and the breaking force is higher than in the case of the known latex plasticzers. These differences are particularly relevant since the breaking strength is relatively low in extremely dry atmospheric conditions. All the values were obtained from 10 measurements each.

EXAMPLE 5

Several highly sensitive colour photographic recording materials were prepared by stacking the layers described below on a layer support of cellulose triacetate. The quantities given are based on 1 $m^2$. The quantities of silver are given in the corresponding quantities of $AgNO_3$.

1st Layer: Anti-halation layer containing 0.52 g of $AgNO_3$, 0.25 g of 2,5-piisooctylhydroquinone and 1.1 g of gelatine 2nd Layer: Intermediate layer containing 0.75 g of gelatine 3rd Layer: Less sensitive red-sensitive layer containing a silver iodobromide emulsion of 2.9 g of $AgNO_3$ (2 mol-% AgI) with 0.51 g of Coupler 2 (cyan coupler), 0.03 g of Coupler 4 (cyan DIR coupler), 0.06 g of Coupler 5 (cyan masking coupler) and 1.5 g of gelatine 4th Layer: More highly sensitive red-sensitive layer containing a silver iodobromide emulsion of 3.5 g of $AgNO_3$ (10 mol-% AgI) with 0.29 g of Coupler 2 and 2.0 g of gelatine 5th Layer: Intermediate layer containing 0.17 g of 2,5-diisooctylhydroquinone and 0.3 g of gelatine 6th Layer: Less sensitive green-sensitive layer containing a silver iodobromide emulsion of 2.5 g $AgNO_3$ (5 mol-% AgI) with 0.52 g of Coupler 6 (magenta coupler), 0.067 g of Coupler 7 (megenta masking coupler), 0.04 g of Coupler 8 (DIR coupler) and 1.7 g of gelatine.

7th Layer: More highly sensitive green-sensitive layer containing a silver iodobromide emulsion of 2.9 g $AgNO_3$ (9 mol-% AgI) with 0.26 g of Coupler 6, 0.055 g of Coupler 7 and 1.65 g of gelatine.

8th Layer: Intermediate layer containing 0.2 g of 2,5-diisooctyl hydroquinone and 0.3 g of gelatine 9th Layer: Filter yellow layer containing 0.13 g of $AgNO_3$ and 0.38 g of gelatine 10th Layer: Less sensitive blue-sensitive layer containing a silver iodobromide emulsion of 1.0 g $AgNO_3$ (6 mol-% AgI) with 1.05 g of Coupler 9 (yellow coupler) and 1.5 g of gelatine 11th Layer: More highly sensitive blue-sensitive layer containing a silver iodobromide emulsion of 0.8 g $AgNO_3$ (8.5 mol-% AgI) with 0.26 g of Coupler 9 and 0.5 g of gelatine 12th Layer: Protective hardening layer containing a carbamoyl pyridinium salt as hardener and 0.3 g of gelatine The following couplers were used:

Coupler 4

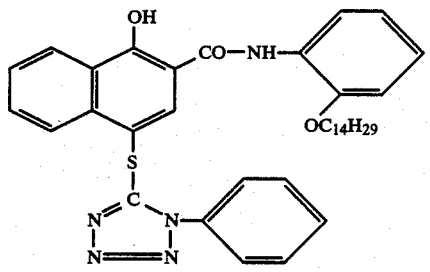

Coupler 5

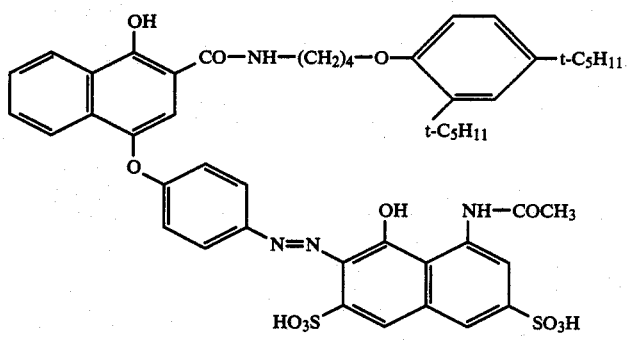

Coupler 6

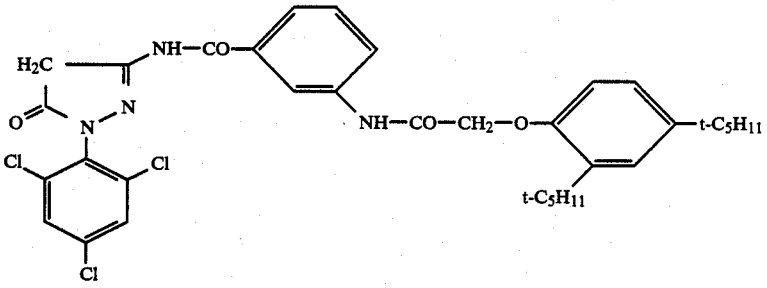

Coupler 7

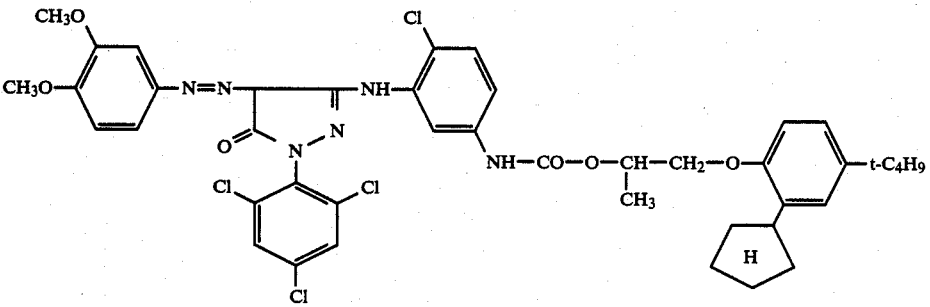

-continued

Coupler 8

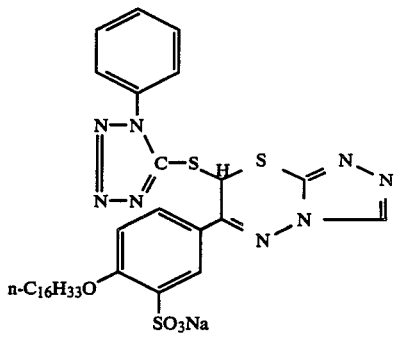

Coupler 9

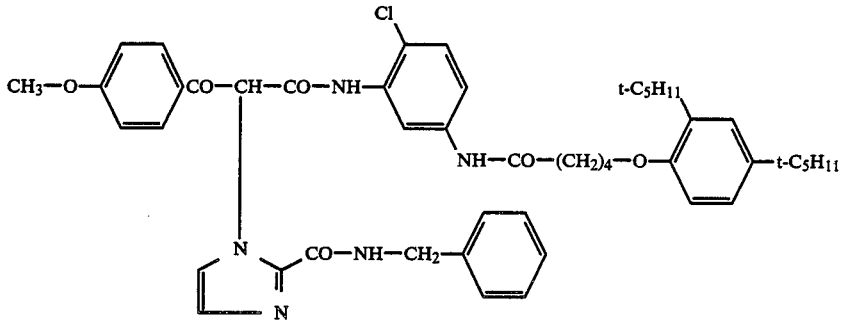

All the couplers with the exception of Coupler 8 which was added in an aqueous alkaline solution were added to the casting solution as an emulsion mixed with an oil former in proportions of 1:1, dibutyl phthalate being used for the red-sensitive layers and tricresyl phosphate for the green-sensitive layers.

A first sample had the composition indicated above. Three further samples were built up in analogous manner but in layers 3, 4, 6, 7, 10 and 11, 20% of the gelatine was replaced by an equal quantity of a softener according to the invention.

After drying at 40° C. with air containing 6 g of $H_2O$ per kg and equilibrating the samples in an atmosphere of 23° C./20% relative humidity, the breaking strength of the loops and the parallel breaking strength (radius at breakage/breaking force) were determined(Table 5).

TABLE 5

| Sample | Plasticizer | Breaking strength: Loop- b.s. (revolutions) | Parallel- b.s. Radius at breakage [mm] | Breaking force [N] |
|---|---|---|---|---|
| (Comparison) | | | | |
| 1 | — | 30 | 2.4 | 10 |
| (according to the invention) | | | | |
| 2 | | 250 | 1.4 | 20 |
| 3 | | 310 | 1.3 | 25 |
| 4 | | 330 | 1.4 | 23 |

To determine the breaking strength of the loops, the film was passed as an endless loop with the layer side outwards over three rollers (diameter of 2 rollers 15 mm, one roller 5 mm). Two of these rollers were rotatably mounted while the third roller kept the loop under tension by its own weight (1 kg). The number of revolutions before breakage occurred was counted.

The breaking strength of the loops was increased from 30 to 250–330 revolutions by using the softeners according to the invention. The breaking force increased and the radius at breakage decreased. The films obtained were substantially less brittle at 20% relative humidity.

Four samples of the recording material described above were exposed to light behind a graduated grey wedge and a sharpness raster and developed for 3¼ minutes at 38° C. in developer having the following composition:

1.2 g Trilon BS
1.5 g potassium bromide
36.3 g potash
1.6 g sodium bicarbonate
2.0 g hydroxylamine sulphate
1.9 g potassium metabisulphite
4.75 g 4-amino-3-methyl-N-ethyl-N-p-hydroxyethylaniline sulphate
made up with water to 1000 ml.

Further processing was carried out as described by E. C. GEHRET, in BRITISH JOURNAL OF PHOTOGRAPHY 1974, page 579. The wedges were measured before and after storage in the drying cupboard (6 days/38° C./80% relative humidity).

The photographic properties such as density, sensitivity and fog were unchanged compared with the corresponding comparison sample and the sharpness measured in lines/mm did not change in the course of storage. No chromatic edges appeared.

We claim:

1. Colour photographic recording material comprising at least one light-sensitive silver halide emulsion layer and at least one light-sensitive or non-light-sensitive gelatine-containing binder layer containing a dispersion of a photographic auxiliary substance, an oil former and a gelatine plasticizer wherein the gelatine plasticizer is a polymer latex in which the dispersed particles consist to an extent of from 80 to 95% by weight of a soft core wherein the polymer has a glass transition temperature $T_g$ below −10° C. and from 5 to 20% by weight of a hard shell wherein the polymer has a glass transition temperature $T_g$ above 36° C.

2. Recording material according to claim 1, characterised in that the polymer of the shell of the dispersed particles is formed by polymerisation of (co)polymerisable, olefinically unsaturated monomers.

3. Recording material according to claim 2, characterised in that the polymer of the shell of the dispersed particles is formed by polymerisation of styrene or an alkyl methacrylate containing 1 to 4 carbon atoms in the alkyl moiety or a monomer mixture consisting to an extent of at least 55% by weight of the above mentioned monomer.

4. Recording material according to claim 3, characterised in that the monomer mixture contains 0 to 20% by weight of water-soluble comonomers and/or 0 to 5% by weight of cross-linking comonomers.

5. Recording material according to claim 2, characterised in that the polymer in the interior of the dispersed particles is formed from (co)polymerisable, olefinically unsaturated monomers by polymerisation.

6. Recording material according to claim 5, characterised in that the polymer in the interior of the dispersed particles is formed from an alkyl acrylate containing 2 to 8 carbon atoms in the alkyl moiety or a mixture of such alkyl acrylates by polymerisation.

7. Recording material according to claim 1, characterised in that the photographic auxiliary substance is a coupler, in particular a colour coupler.

* * * * *